US010421207B2

(12) United States Patent
Weidhaas, Sr.

(10) Patent No.: US 10,421,207 B2
(45) Date of Patent: Sep. 24, 2019

(54) ADJUSTABLE CLAMSHELL PRESS

(71) Applicants: Robert G. Weidhaas, Sr., Lakeville, PA (US); Phoenix Partners, LLC, Millville, NJ (US)

(72) Inventor: Robert G. Weidhaas, Sr., Lakeville, PA (US)

(73) Assignee: Phoenix Partners, LLC, Millville, NJ (US)

( * ) Notice: Subject to any disclaimer, the term of this patent is extended or adjusted under 35 U.S.C. 154(b) by 419 days.

(21) Appl. No.: 15/344,082

(22) PCT Filed: Oct. 6, 2015

(86) PCT No.: PCT/US2015/054224
§ 371 (c)(1),
(2) Date: Nov. 4, 2016

(87) PCT Pub. No.: WO2016/057501
PCT Pub. Date: Apr. 14, 2016

(65) Prior Publication Data

US 2017/0080593 A1 Mar. 23, 2017

Related U.S. Application Data

(60) Provisional application No. 62/061,854, filed on Oct. 9, 2014.

(51) Int. Cl.
*B26F 1/40* (2006.01)
*B30B 15/00* (2006.01)
(Continued)

(52) U.S. Cl.
CPC ..... *B26F 1/40* (2013.01); *B26D 5/14* (2013.01); *B30B 1/26* (2013.01); *B30B 15/00* (2013.01); *B30B 15/0041* (2013.01)

(58) Field of Classification Search
CPC .. B26D 5/14; B26D 5/16; B30B 1/263; B30B 1/26; B30B 15/0029; B26F 1/40;
(Continued)

(56) References Cited

U.S. PATENT DOCUMENTS 2,223,281 A 11/1940 Dinzl
2,338,352 A 1/1944 Paque
(Continued)

FOREIGN PATENT DOCUMENTS

WO WO-9846400 A1 * 10/1998 ..... B26D 5/00

OTHER PUBLICATIONS

International Search Report and Written Opinion for PCT/US15/54224, dated Dec. 28, 2015, 11 pages.

*Primary Examiner* — Elaine Gort
*Assistant Examiner* — Christopher B Wehrly
(74) *Attorney, Agent, or Firm* — Zhong Law, LLC

(57) ABSTRACT

A clamshell die cutting press (10) that can transition between an opening of three inches and 0.937" and anywhere in between without the requirement of filler plates. This is accomplished by attaching the connecting rod or arm (20) that extends between the fixed platen (14) and the movable platen (16) to the fixed platen through an eccentric bevel gear (26). The bevel gear (26) is driven by an electric motor (28) which allows the adjustment to be made with a push of a button, and by moving the bridge rocker plates (34 and 36) and bridge cam stands using linear slides and servo motors.

12 Claims, 3 Drawing Sheets

(51) Int. Cl.
*B26D 5/14* (2006.01)
*B30B 1/26* (2006.01)

(58) Field of Classification Search
CPC ..... B41F 13/28; B41F 13/30; B41F 13/36; B31F 1/07
USPC ..... 100/257, 291, 282, 233, 236, 918; 72/451, 450; 83/628, 629
See application file for complete search history.

(56) References Cited

U.S. PATENT DOCUMENTS

| | | | | |
|---|---|---|---|---|
| 3,473,995 | A * | 10/1969 | Schott, Jr. | B29C 65/18 156/513 |
| 4,360,335 | A | 11/1982 | West | |
| 4,416,198 | A * | 11/1983 | Rasenberger | F16H 21/40 101/142 |
| 5,152,204 | A | 10/1992 | Trevizo | |
| 5,666,838 | A | 9/1997 | Dudick et al. | |
| 5,865,070 | A | 2/1999 | Bomhorst et al. | |
| 5,997,453 | A | 12/1999 | Weidhaas, Sr. et al. | |
| 6,058,834 | A * | 5/2000 | Beckwith | B30B 1/12 100/233 |
| 6,935,228 | B2 * | 8/2005 | Brandtjen, Jr. | B30B 1/00 100/233 |
| 7,484,806 | B2 * | 2/2009 | Ito | B60N 2/2252 297/362 |
| 2006/0083571 | A1 * | 4/2006 | Sawai | B41J 13/025 400/120.17 |
| 2008/0178652 | A1 | 7/2008 | Baba et al. | |

* cited by examiner

ADJUSTABLE CLAMSHELL PRESS

CROSS-REFERENCE TO RELATED APPLICATIONS

This application is a U.S. National Stage application of International Application No. PCT/US2015/054224, filed Oct. 6, 2015, which is related to and claims the benefit of U.S. patent application No. 62/061,854, filed Oct. 9, 2014, both of which are incorporated herein by reference in their respective entireties.

TECHNICAL FIELD

The present invention is directed toward an improvement to clamshell presses and more particularly to an improvement that allows the press opening dimension or stroke position between the movable platen and the fixed platen of a clamshell press to be quickly, easily and safely adjusted.

BACKGROUND ART

Clamshell presses are frequently used to die cut cardboard, plastic sheets, corrugated board and the like. They are well known in the art as shown, for example, in U.S. Pat. No. 5,997,453, the entire content of which is hereby incorporated herein by reference.

Currently, clamshell presses have not been extensively used to die cut structural board such as Falcon Board or Xaniata Board. The manufacturers of these boards advise their customers to convert (cut to shape) the boards using router/plotter tables. It has not been believed that such boards could be die cut or die cut with the same edge quality as a router table. This is because the boards collapse while die cutting or the edge quality is poor and not acceptable to the user.

It has been found that these structural boards can be successfully die cut using special two inch and even three inch tooling. However, this requires a press with an opening of three inches. Since standard tooling height worldwide is 0.937 inches (with some 1.125 inch configurations) this would require significant changes to the press.

It is known to construct clamshell presses with three inch openings to accommodate three inch knives. When a run using smaller knives is to be done, either extensive timely adjustments have to be made to the press or filler plates can be used. While the use of filler plates may achieve the desired press opening or shut height, it is still time consuming and dangerous to employ them as they are very heavy and bulky. It frequently takes several men and heavy equipment to move a filler plate.

Furthermore, while the use filler plates may be possible with smaller presses, they would be totally impractical with the size of presses that are needed to convert structural board. The market for structural boards is large format, i.e., 63"×108" and 63"×123". Thus, while it is theoretically possible to design a press for a three inch opening to accommodate a three inch knife and incorporate removable filler plates, it simply is not viable to utilize such large filler plates. Filler plates of this size would weigh thousands of pounds.

There is, therefore, a need for a clamshell die cutting press that is large enough to effectively convert structural board but wherein the press opening can be easily and quickly reduced without requiring the use of filler plates.

DISCLOSURE OF THE INVENTION

The present invention is designed to overcome the deficiencies of the prior art discussed above. Accordingly, it is an object of the invention to provide a clamshell die cutting press that is large enough to effectively convert structural board but wherein the press opening can be reduced to die cut other products.

It is a further object of the present invention to provide a clamshell die cutting press that is large enough to effectively convert structural board but wherein the press opening can be reduced without requiring the use of filler plates.

It is a still further object of the present invention to provide a clamshell die cutting press that can transition between an opening of three inches and 0.937" and anywhere in between at the push of a button.

In accordance with the illustrative embodiment demonstrating features and advantages of the present invention, there is provided a clamshell die cutting press that can transition between an opening of three inches and 0.937" and anywhere in between without the requirement of filler plates. This is accomplished in two key ways: 1) by attaching the connecting rod or arm that extends between the crank pin on the structure of the fixed platen and the bearing attachment on the movable platen, through a powered eccentric housing; and 2) by moving the bridge rocker plates and bridge cam stands using powered linear slides. In this arrangement, it is also possible to use servo motors and gearboxes to afford, by means of push button operation, the capability of simultaneously or incrementally adjusting the moveable platen by means of rotating the eccentric housing and bushing attached to the connecting rod and activating linear screw jacks attached to the linear slides.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

BEST MODE FOR CARRYING OUT THE INVENTION

Figure 1:
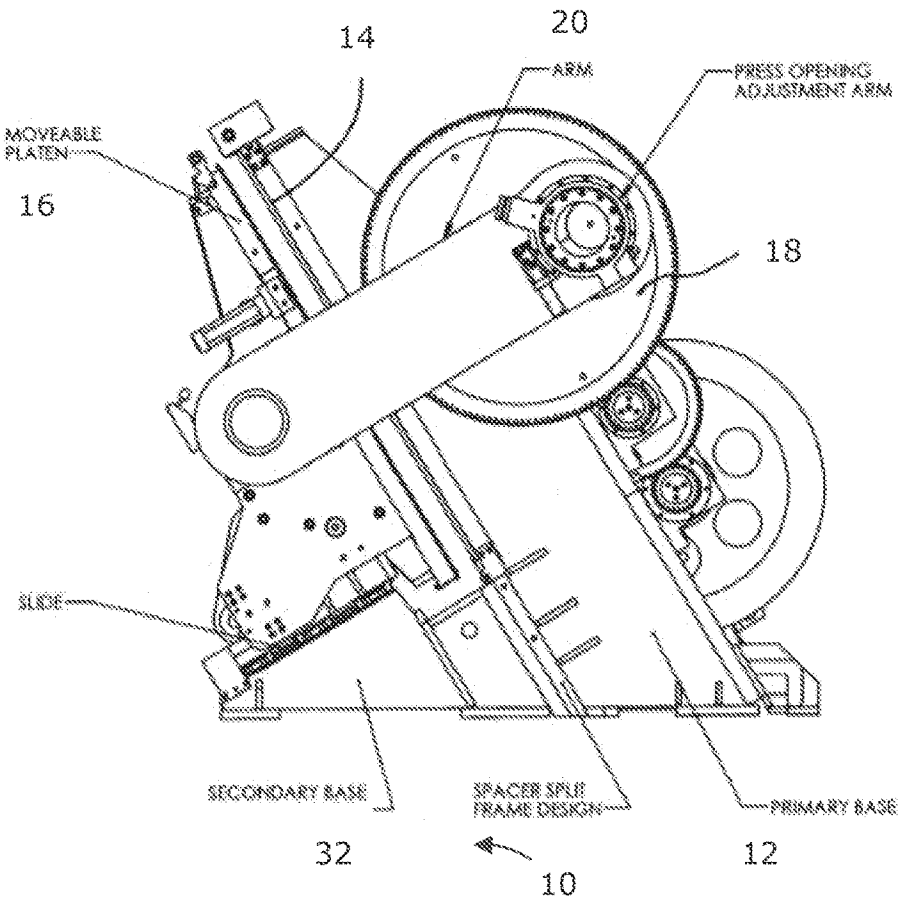
FIG. 1 is a side elevational view of the clamshell press of the present invention.

Referring now to the drawings in detail wherein like reference numerals have been used throughout the various figures to designate like elements, there is shown in FIG. 1 an adjustable clamshell press constructed in accordance with the principles of the present invention and designated generally as 10. The clamshell press 10 is comprised of a base or frame 12 having a fixed platen 14 secured thereto and a movable platen 16 that is movable between an inoperative position and an operative position. In FIG. 1, the movable platen 16 is shown in its operative position wherein it is adjacent and parallel to the fixed platen 14.

The movable platen 16 is moved through the use of a crank pin gear (or toggle drive or the like) 18 carried by the frame 12 and a connecting arm 20 extending between the crank pin and the movable platen 16. While not shown in the drawing, an identical arrangement is located on the far side of the press. Accordingly, while the following description of the improvement of the invention applies equally to the crank pin drive 18 and connecting arm 20 that are shown, the improvement applies equally to the same components on the far side of the press.

The clamshell press thus far described is conventional in the art and, as pointed out above, is described, for example, in U.S. Pat. No. 5,997,453. Accordingly, a detailed description of the operation thereof is not believed to be necessary. Suffice it to say that as the crank pin gear is rotated, the movable platen 16 moves away from or towards the fixed platen 14.

Figure 2:
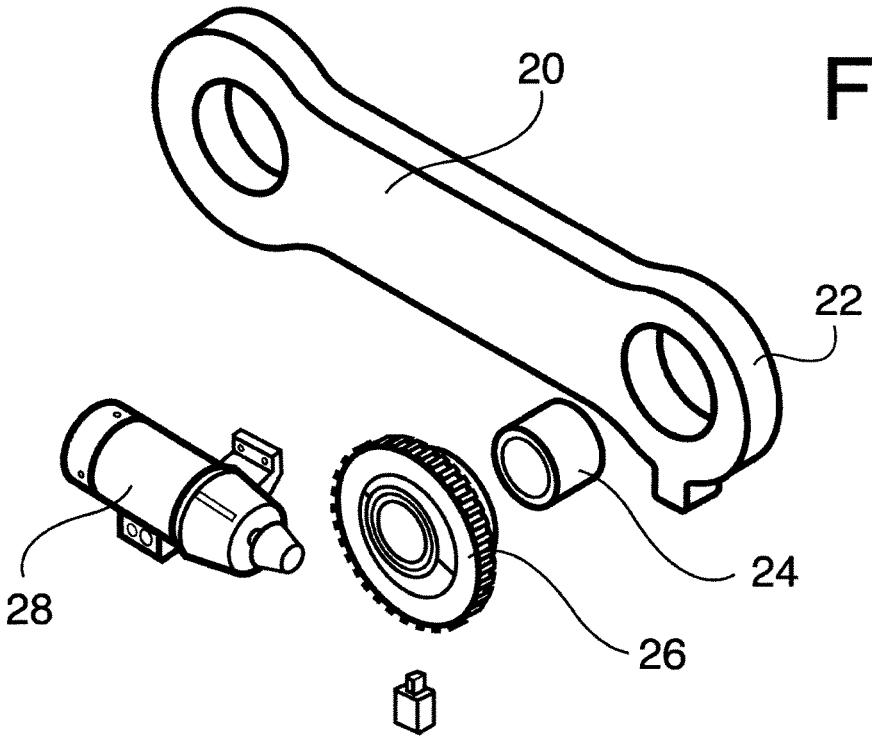
FIG. 2 is an exploded view of the improved toggle connecting rod or arm of the invention.
Figure 3:
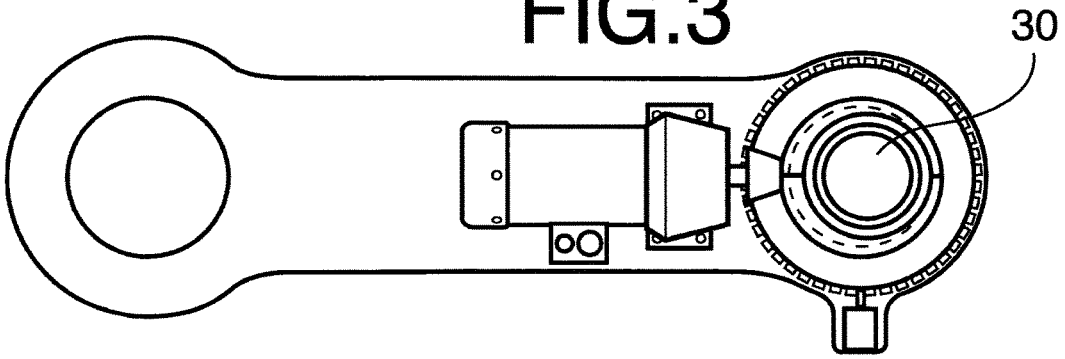
FIGS. 3 and 4 illustrate the two extreme adjustment positions that can be obtained using the invention.
Figure 4:
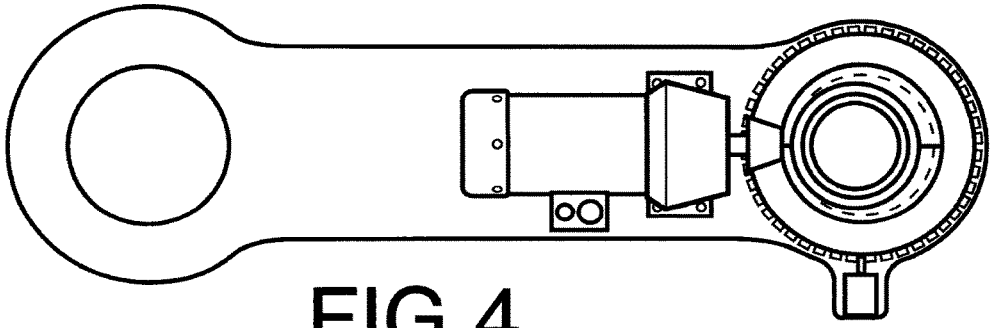
Figure 5:
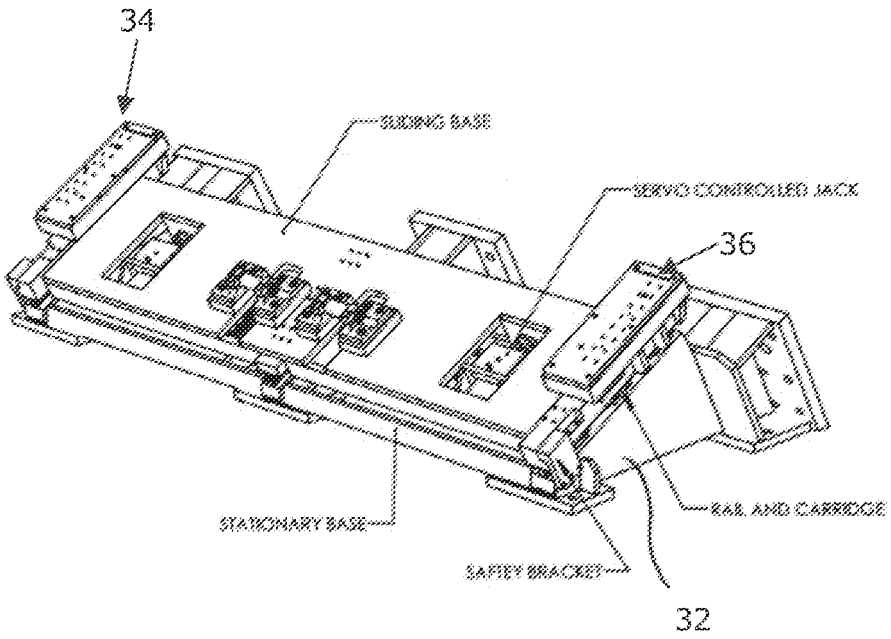
FIG. 5 is a perspective view of the adjustable sliding base for supporting and adjusting the position of the movable platen.

FIGS. 2, 3, and 4 show the details of the improvement of the invention. More particularly, the end 22 of the connecting arm 20 is fitted with a bushing 24 and a drive mechanism 26 and 28, consisting of an eccentric housing driven by a bevel or worm gear etc. and a servo motor or other powered device. These mechanisms are mounted on the connecting arm 20 and are adapted to rotate the eccentric housing containing the bushing so as to change the position of the center 30 thereof. This obviously can be done remotely.

As shown in FIGS. 3 and 4, by rotating the eccentric housing containing bushing 24 using the attached bevel gear or worm 26 and servo 28, the center 30 of the bushing 24 can be moved between the two extreme positions shown therein. Obviously, FIGS. 3 and 4 show the extreme positions only. The center 30 of the eccentric housing and bushing can be positioned anywhere in between.

As should also be obvious to those skilled in the art, when the center 30 of the eccentric is in the position shown in FIG. 3, the movable platen 16 will be furthest from the fixed platen 14 when in their operative position. When the center 30 of the eccentric is in the position shown in FIG. 4, the movable platen 16 will be closest to the fixed platen 14 when in their operative position. Using the servo motor 28, any position between the extreme positions, and including the extreme positions, can be selected. Furthermore, using the computer controls, any number of fixed positions can be preset and then selected with the simple push of a button.

Because the position of the movable platen 16 is changed by the movement of the eccentric housing 26, it is also necessary to change the position of the movable platen rocker plates 34 and 36 that are part of the sliding base, and bridge cam stands relative to its support 32 in order to maintain the correct geometry of the movable platen.

The present invention may be embodied in other specific forms without departing from the spirit or essential attributes thereof and accordingly, reference should be made to the appended claims rather than to the foregoing specification as indicating the scope of the invention.

The invention claimed is:

1. A clamshell press comprising:

a fixed platen mounted on a base;

a slide mounted on a secondary base that is supported by the base;

a movable platen supported by a rocker plate that is adjustably mounted on the slide, wherein the movable platen is movable between a close position at which the movable platen is substantially parallel to the fixed platen at a gap distance and an open position at which a portion of the movable platen is away from the fixed platen; and an arm comprising a first end connected to a crank pin mounted on the base and a second end connected to the movable platen, wherein the first end is coupled to the crank pin via an eccentric housing with a bevel gear, and wherein a rotational adjustment of the bevel gear causes a shift of a center position of the eccentric housing and a corresponding movement of the rocker plate along the slide, resulting in an adjustment of the gap distance between the fixed platen and the movable platen at the close position, and an electric motor engaged to the bevel gear to provide a driving force causing the rotational adjustment of the bevel gear and the adjustment of the gap distance, wherein the rocker plate is mounted on the slide, and wherein the electric motor simultaneously drives the bevel gear and activates a jack attached to the slide to cause the movement of the rocker plate.

2. The clamshell press of claim 1, wherein the gap distance is adjusted between a low point corresponding to a first extreme center position of the eccentric housing and a high point corresponding to a second extreme position of the eccentric housing.

3. The clamshell press of claim 1, wherein the gap distance is adjusted in a range between 0.937 inches and three inches.

4. The clamshell press of claim 1, wherein the eccentric housing contains a bushing through which the arm is coupled to the crank pin, and wherein the first end of the arm is coupled to the crank pin at an off-center position of the crank pin.

5. The clamshell press of claim 1, further comprising a computer controller for controlling the electrical motor, the computer controller comprising a button, and wherein an activation of the button causes to adjust the gap distance to a preset value.

6. The clamshell of claim 1, wherein the shift of the center position of the eccentric housing matches the shift of the rocker plate along the slide.

7. The clamshell press of claim 1, further comprising: a second arm that is substantially identical to the arm.

8. An apparatus comprising:

a fixed platen mounted on a base;

a movable platen supported by a rocker plate that is adjustably mounted on a slide, wherein the slide is supported by a secondary base attached to the base, wherein the movable platen is movable between a close position at which the movable platen is substantially parallel to the fixed platen at a gap distance and an open position at which a portion of the movable platen is away from the fixed platen; and an arm comprising a first end connected to a crank pin mounted on the base and a second end connected to the movable platen, wherein the first end is coupled to the crank pin via an eccentric bevel gear coupled to a bushing, and wherein a rotational adjustment of the eccentric bevel gear causes a shift of a center position of the bushing and a corresponding movement of the rocker plate along the slide, resulting in an adjustment of the gap distance between the fixed platen and the movable platen at the close position, and an electric motor engaged to the eccentric bevel gear to provide a driving force causing the rotational adjustment of the eccentric bevel gear and the adjustment of the gap distance, wherein the rocker plate is mounted on the slide, and wherein the electric motor simultaneously drives the eccentric bevel gear and activates a jack attached to the slide to cause the movement of the rocker plate.

9. The apparatus of claim 8, wherein the gap distance is adjusted between a low point corresponding to a first extreme center position of the bushing and a high point corresponding to a second extreme position of the bushing.

10. The apparatus of claim 8, wherein the gap distance is adjusted in a range between 0.937 inches and three inches.

11. The apparatus of claim 8, further comprising a computer controller for controlling the electrical motor, the computer controller comprising a button, and wherein an activation of the button causes to adjust the gap distance to a preset value.

12. The apparatus of claim 8, wherein the shift of the center position of the bushing matches the shift of the rocker plate along the slide.

* * * * *